US008789539B2

(12) United States Patent
Linglin et al.

(10) Patent No.: US 8,789,539 B2
(45) Date of Patent: Jul. 29, 2014

(54) HAIR-CARE DEVICE WITH JAWS

(75) Inventors: Benoît Linglin, Cruseilles (FR); Régis Fereyre, Chavanay (FR); Bénédicte Simond, Marcellaz-Albanais (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 13/144,240

(22) PCT Filed: Jan. 15, 2010

(86) PCT No.: PCT/FR2010/000035

§ 371 (c)(1),
(2), (4) Date: Jul. 12, 2011

(87) PCT Pub. No.: WO2010/081969

PCT Pub. Date: Jul. 22, 2010

(65) Prior Publication Data

US 2012/0024311 A1 Feb. 2, 2012

(30) Foreign Application Priority Data

Jan. 15, 2009 (FR) ..... 09 00168
Apr. 15, 2009 (FR) ..... 09 52474

(51) Int. Cl.
*A45D 1/00* (2006.01)

(52) U.S. Cl.
USPC ..... 132/224

(58) Field of Classification Search
USPC ..... 132/223–227, 229, 231–233; D28/35, D28/38; 219/225
See application file for complete search history.

(56) References Cited

U.S. PATENT DOCUMENTS

| | | | | |
|---|---|---|---|---|
| 6,653,599 | B2 * | 11/2003 | Nam | 219/222 |
| 7,341,064 | B2 * | 3/2008 | Habibi | 132/224 |
| 7,380,556 | B2 * | 6/2008 | Carballada et al. | 132/224 |
| 7,445,012 | B2 * | 11/2008 | Mukai | 132/224 |
| 7,465,904 | B2 * | 12/2008 | Kim et al. | 219/222 |
| 7,931,031 | B2 * | 4/2011 | LeGrain | 132/269 |
| 8,066,016 | B2 * | 11/2011 | Henninger et al. | 132/224 |
| 8,071,915 | B2 * | 12/2011 | Mukai | 219/225 |
| 2005/0081876 | A1 * | 4/2005 | Choi | 132/224 |
| 2006/0196523 | A1 | 9/2006 | Choi | |

(Continued)

FOREIGN PATENT DOCUMENTS

| | | | |
|---|---|---|---|
| EP | 1698249 | A1 | 9/2006 |
| JP | 2001-104036 | * | 12/1999 |

(Continued)

*Primary Examiner* — Rachel Steitz
*Assistant Examiner* — Jennifer Gill
(74) *Attorney, Agent, or Firm* — The Webb Law Firm

(57) ABSTRACT

A hair-care device includes at least two jaws, a first jaw and a second jaw. The first and second jaw are elongated and hinged together so as to be able to shift between an open position and a closed position in which opposing working surfaces define a hair treatment region. An electric heating element is attached to at least one of the working surfaces. The first jaw includes at least one friction bar which is able to move along an adjacent working surface and which is adapted to engage with an opposing element of the second jaw to create, when the jaws are closed, a traction region which generates a traction force which exceeds the traction force generated by the treatment region as the device is moved over a lock of hair.

17 Claims, 7 Drawing Sheets

(56) References Cited

U.S. PATENT DOCUMENTS

| | | | | |
|---|---|---|---|---|
| 2006/0201924 | A1* | 9/2006 | Hirata et al. | 219/225 |
| 2007/0240731 | A1* | 10/2007 | Mukai | 132/224 |
| 2008/0283080 | A1* | 11/2008 | Habibi | 132/224 |
| 2009/0114240 | A1* | 5/2009 | Leung | 132/224 |
| 2010/0078038 | A1* | 4/2010 | Shami et al. | 132/224 |
| 2011/0120491 | A1* | 5/2011 | You | 132/223 |
| 2011/0174331 | A1* | 7/2011 | Kim | 132/229 |
| 2011/0226278 | A1* | 9/2011 | Rivola | 132/232 |
| 2012/0291797 | A1* | 11/2012 | deGrood et al. | 132/211 |

FOREIGN PATENT DOCUMENTS

| | | | |
|---|---|---|---|
| JP | 2001104036 | A | 4/2001 |
| WO | 2009007823 | A2 | 1/2009 |
| WO | 2009046320 | A1 | 4/2009 |

* cited by examiner

HAIR-CARE DEVICE WITH JAWS

BACKGROUND OF THE INVENTION

1. Field of the Invention

This invention concerns the technical field of hair-care devices such as curling irons and straighteners.

2. Description of Related Art

However, such equipment usually consists of two jaws, at least one of which is heated, and which are hinged in order to pinch a lock of hair to be shaped. One or both of the jaws is/are then heated directly or indirectly by an electrical heating element the temperature of which is regulated by a thermostatic system to reach a pre-determined temperature based on a temperature value that may be selected by a user of the device.

SUMMARY OF THE INVENTION

With a certain amount of practice, such a hair-care device allows good straightening results to be obtained. Good straightening results are obtained by applying significant pressure to keep the jaws closed and by applying sufficient pressure on the lock of hair to be straightened. Optionally, the user may have to use both hands to increase the pressure and achieve a better result. In all cases, continuing to apply this strong pressure throughout the hair treatment cycle is difficult and uncomfortable for the user. Laboratory testing has shown that the combination of the tension on the hair and heat applied by the iron with reasonable tightening pressure allows equivalent or even better results to be obtained compared to using only the iron and applying greater pressure.

To resolve the aforementioned difficulty and discomfort and having to use two hands, a new type of straightener is required that would meet these requirements of applying tension to the hair and heating without using two hands to make the user's job easier.

To achieve this goal, the invention covers a hair-care device including at least:

- two jaws, a first and a second, parallel and attached to one another so that they can move between an open position and a closed position in which their working surfaces create a hair treatment region, and
- an electrical heating mechanism for at least one of the working surfaces.

In accordance with the invention, the first jaw includes at least one friction bar which is mobile relative to the adjacent working surface which is designed to work with an opposite element to create, when the jaws are in a closed position on a lock of hair, a traction region which, when the device is moved, generates a traction force on the lock of hair which exceeds the traction force generated by the treatment region. "Mobile friction bar relative to the adjacent working surface" refers to the relative mobility of the two parts. Accordingly, the friction bar may be fixed relative to the jaw and the working surface mobile relative to the jaw, the friction bar may be mobile relative to the jaw and the working surface fixed relative to the jaw, or the friction bar may be mobile relative to the jaw and the working surface mobile relative to the jaw, but in a different manner. The friction bar is also called a traction bar.

To generate this differential traction force, the friction bar may, for example, be designed so that, when the jaws are in a closed position, the traction region provides a coefficient of friction which exceeds the coefficient of friction of the treatment region.

Therefore, this difference in traction or friction allows a user who has positioned the hair-care device so that the treatment region is located between the traction region and the scalp to stretch the portion of the hair located between the scalp and the traction region and, therefore and in particular, the hair located in the treatment region, so that the heating of the hair held in traction in the treatment region allows optimal straightening to be achieved, which very significantly exceeds the straightening achieved from simply heating the hair.

In accordance with the invention, the element that works with the friction bar may either be provided by the second jaw or by the first jaw.

In addition, in accordance with the invention, the friction bar may be located either at the exterior edge of the treatment region or, on the other hand, at the center thereof so that the user does not have to be concerned about the direction in which he/she uses the hair-care device in accordance with the invention.

The friction bar may be adjacent to the exterior edge of the treatment surface and in contact with the treatment surface of the same jaw; said treatment surface has a flat surface plane designed to enter into contact with the lock of hair. The friction bar may push against the edge of the treatment surface, under the treatment surface and/or under the lateral edges of the treatment surface.

In accordance with the invention, the movement of the friction bar relative to the adjacent working surface may be achieved in various manners.

An initial variation to create, the friction bar is mobile relative to the first jaw and the device includes compelling mechanisms, located between the friction bar and the first jaw, which are designed to extend the friction bar of the first jaw, i.e., which push the friction bar toward the second jaw.

The compelling mechanisms may then be created in any appropriate manner, e.g., but not exclusively, in the form of one or more springs compressed between the friction bar and the first jaw. The compelling mechanisms could also be created using magnetic, electromechanical, pneumatic or hydraulic systems. The compelling mechanisms may also be combined with mechanisms to control the intensity of the restriction that they create.

In accordance with the invention, the working surface may be fixed relative to the jaw on which it is mounted while the friction bar is mobile relative to the first jaw and, therefore, to the working surface. However, in accordance with the invention, the working surface may also be mobile relative to the first jaw on which it is mounted. In that case, the friction bar may be immobile relative to the jaw or mobile, depending on the compelling mechanisms, e.g., below the compelling mechanisms on the working surface. The result is still that the traction region which generates a traction force on the lock of hair when the device is moved exceeds the traction force generated by the adjacent treatment region.

In accordance with a variation of the invention, the working surface which is adjacent to the first friction bar is formed by a straightening plate which is mobile relative to the first jaw.

Under this variation of the invention, the friction bar and the straightening plate may be mobile independently one of the other relative to the first jaw on which they are mounted. The friction bar could also be fixed relative to the first jaw while the straightening plate is mobile relative to it.

If the working surface of the first jaw is formed by a mobile straightening plate, the straightening device, in accordance with the invention, could consist of motion restriction compelling mechanisms located between the straightening plate and the first jaw, which extends the friction bar of the first jaw.

If the friction bar and the straightening plate are both mobile relative to the first jaw, independent of one another and each connected to compelling mechanisms, the compelling mechanisms attached to the straightening plate may be adjusted to restrict that plate less than the restriction on the friction bar by the compelling mechanisms attached to that bar. Such a pressure differential ensures that the friction will be higher on the friction bar than on the straightening plate. Thus, when the device is moved, the traction region will apply a traction force to the lock of hair which exceeds the traction force generated by the treatment region, which ensures optimal tension on the hair. This friction differential may also be optimized using materials that have different coefficients of friction between, on the one hand, the contact surface of the friction bar with the hair and, on the other hand, the contact surface of the straightening plate with the hair. Accordingly, there are at least three combinations for the friction bar which is mobile relative to the adjacent working surface: the friction bar is mobile relative to the jaw and the adjacent working surface is mobile relative to the jaw; the friction bar is mobile relative to the jaw and the adjacent working surface is immobile relative to the jaw; and the friction bar is immobile relative to the jaw and the adjacent working surface is mobile relative to the jaw.

In accordance with another implementation of the hair-care device in accordance with the invention:

- the friction bar is located on a free end of an arm which is hinged to an end attached to the first jaw,
- the working surface, which is adjacent to the friction bar, is formed by a straightening plate which is mobile in translation relative to the first jaw in a direction perpendicularly along the longitudinal axis of the first jaw,
- the first straightening plate has a built-in traction finger to exert traction on the hinged arm when the straightening plate moves opposite the friction bar.

In its rest position, the hinged arm is preferably then inclined relative to the working surface of the straightening plate so that the traction generated thereby on the arm extends the friction bar of the first jaw and, therefore, pinches the lock of hair between that friction bar and the opposite element of the second jaw. Therefore, this type of implementation allows the lock of hair to be pinched and held in a predetermined manner relative to the movement of the hair-care device.

To allow the lock of hair to be pinched and tension automatically added in either directions in which the hair-care device can move, the device may also be implemented so that:

- the first jaw includes a second friction bar located opposite the first friction bar relative to the straightening plate which is mounted on a free end of a second arm which is hinged to an opposing end on the first jaw; the second friction bar works with an element on the second jaw to create a second traction region with a coefficient of friction which exceeds the coefficient of friction of the treatment region,
- the straightening plate has a built-in second traction finger to generate traction on the hinged arm when the straightening plate moves against the second friction bar.

In accordance with the invention, the element located relative to each friction bar may be of any type, e.g., consisting of part of a straightening plate mounted on the second jaw. The portion opposite each friction bar may also be formed by a friction bar mounted on the second jaw; this second friction bar or counter-friction bar may then have a structure similar to that of the friction bar on the first jaw which is mobile relative to the adjacent working surface. Accordingly, the hair-care device may be implemented so that:

- the second jaw also includes a counter-friction bar which is mounted on a free end of an arm which is hinged to an opposing end on the second jaw; the counter-friction bar on the second jaw is positioned opposite a friction bar on the first jaw to form the traction region,
- the working surface of the second jaw, adjacent to the friction bar, is formed by a second straightening plate which is mobile relative to the second jaw which moves perpendicularly to the longitudinal axis of the second jaw,
- the second straightening plate has a built-in traction finger to generate friction on the hinged arm when the straightening plate moves against the counter-friction bar.

Similarly, in accordance with the invention, the hair-care device may be implemented so that:

- the second jaw includes a second counter-friction bar located opposite the first counter-friction bar relative to the second straightening plate which is mounted on a free end of a second arm which is hinged to an opposite end on the second jaw; the second counter-friction bar works with the second friction bar of the first jaw in a pre-determined manner to create a second traction region,
- the second straightening plate has built-in a second traction finger to exert traction on the second hinged arm when the second straightening plate moves against the second counter-friction bar.

To ensure optimal friction differential between the treatment region and the traction region, in accordance with the invention, the hair-care device may be implemented so that, when the jaws are in the open position, each working surface of a jaw is retracted from each friction bar or each counter-friction bar mounted on said jaw. The size of this retracted position is measured perpendicularly to the working surface and may, for example, be between 0.1 mm and 5 mm.

In another implementation of the hair-care device, the first jaw includes multiple friction bars each of which are mobile relative to the adjacent working surface in a direction parallel to the longitudinal axis of the first jaw which each form a tooth which works with a counter-tooth to create a traction region. Each counter-tooth may then be mounted on the first jaw or, in the opposite manner, by the second jaw.

In addition, in all of the previously described methods of implementing the invention, the friction bar may be cold or hot.

It may be heated using a "passive" heating mechanism, with the energy coming from the plate by thermal conduction, and/or heated using an "active" heating element, in particular, CTP or ceramic-type electrical heaters.

If thermal conduction heating is used, the adjacent friction bar(s) are in at least partial contact with at least one of the working surfaces, which is itself heated by electrical means. Contact may be on the side and/or on the bottom of the working plate. The traction bar may be on the side of the exterior edge of the treatment surface and in thermal contact with the treatment surface of the same jaw; this treatment surface has a flat surface designed to make thermal contact with the lock of hair. The traction bar may press against the side of the treatment surface, under the treatment surface, and/or under the lateral edges of the treatment surface.

If electrical heating is used, these electrical heating elements may then be the heating elements attached to the adjacent working surface or separate electrical heating, in addition to those used to heat the adjacent working surface. Of course, the various characteristics, forms and variants to implement the invention may be used with one another in various combinations, provided that they are not incompatible or mutually exclusive.

Also, regardless of how the invention described is implemented, the friction bar or the surface of the friction bar which is designed to be in contact with the lock of hair may consist of or be coated at least partially with a different material, in particular, silicone. The silicone layer can be between 1 and 10 mm thick; it can have a hardness of between 5 and 90 shores, preferably between 40 and 50 shores and preferably equal to 46 shore A. Silicone is resistant to high temperatures up to at least 100° C., or even 150° C., or up to approximately 270° C., or even 300° C.

This silicone may be molded on, attached to or slid over the friction strip clip. The purpose of this silicone is to evenly stretch, hold and flatten the lock of hair on the counter-support of the friction bar. Of course, any material other than silicone that achieves least one of the three results listed may be used by those skilled in the art.

BRIEF DESCRIPTION OF THE DRAWINGS

In addition, various other characteristics and advantages of the invention emerge from the description below, which refers to the attached designs which show certain, but not all of, the implementations of a hair-care device in accordance with the invention.

DETAILED DESCRIPTION OF THE INVENTION

In these figures, the common references designate the elements common to the various implementations.

Figure 1:
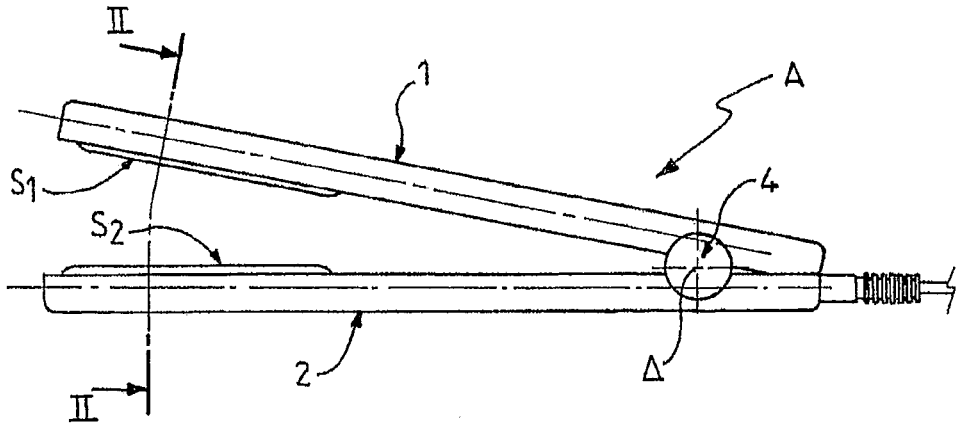
FIG. 1 shows a side view of a hair-care device in accordance with the invention the jaws of which are in position open.

A hair-care device according to the invention, as illustrated in FIG. 1 which is designated in its entirety as "A", includes two elongated jaws 1 and 2, generally in the form of a parallelepiped, each of which extends along longitudinal axis L. Jaws 1 and 2 are attached at one end by hinge or pivot connection 4 with an axis Δ. Accordingly, jaws 1 and 2 are hinged with respect to one another and move between an open position O as shown in FIGS. 1 and 2A-2C, and a closed position shown in FIG. 3. Each jaw 1 and 2 includes near one end opposite connection 4 working surfaces labeled $S_1$ and $S_2$, respectively. These working surfaces $S_1$ and $S_2$ are located opposite one another and extend over only a portion of the length of jaws 1 and 2 to create a hair treatment region when they are in a closed position. In the example shown, each working surface $S_1$ and $S_2$ creates a generally rectangular shape and is made from thermally conductive material with surface characteristics suitable for being placed into contact with hair without a risk of damaging it. Accordingly, each working surface $S_1$ and $S_2$ could, for example, be smooth from polishing or possibly from a coating of enamel, a ceramic, a polymer with a weak coefficient of friction, enamel with a weak coefficient of friction or even a layer of glass.

Figure 2A:
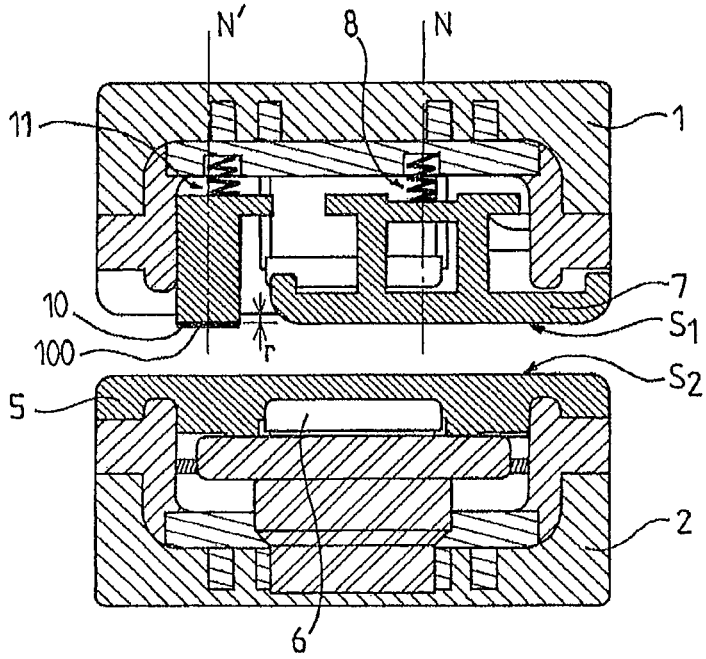
FIG. 2A shows a straight transverse section along line II-II of the jaws of the hair-care device illustrated in FIG. 1 with the jaws in an open position.
Figure 3:
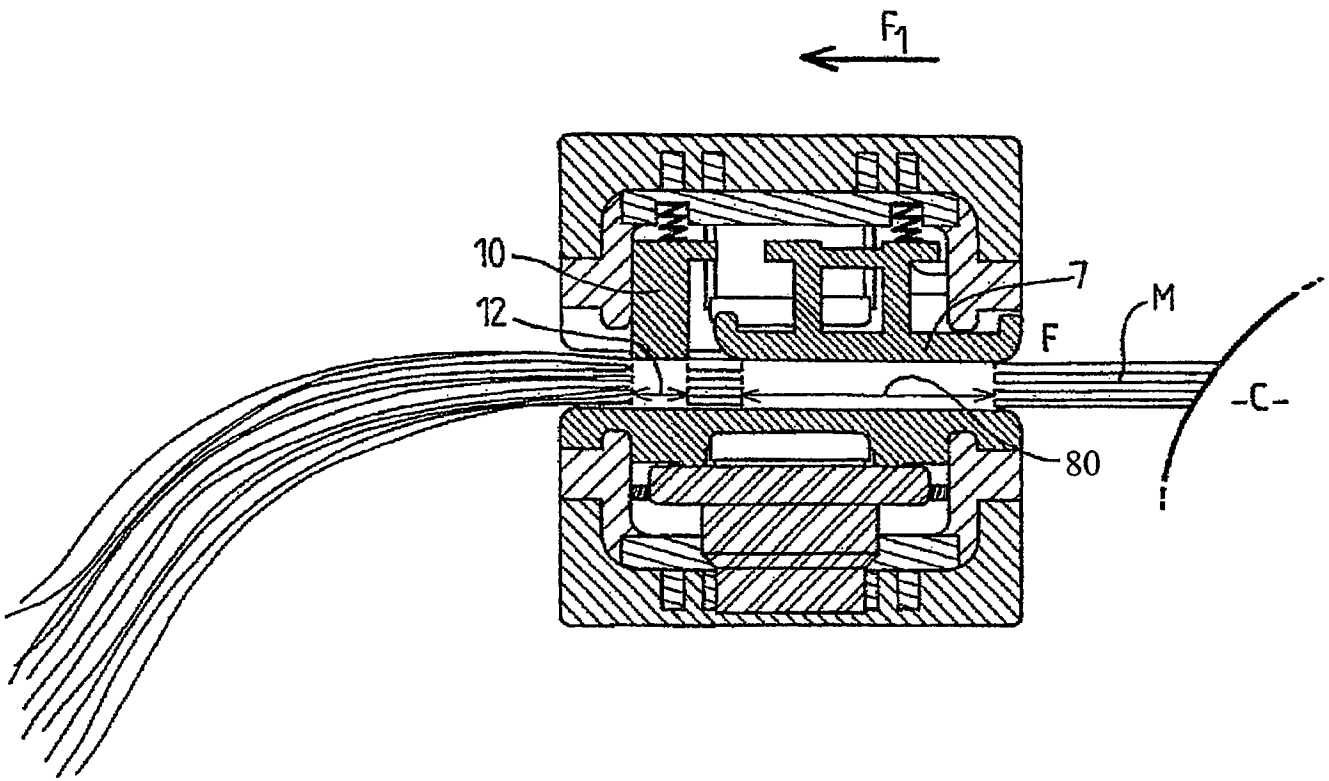
FIG. 3 shows a straight transverse section similar to FIG. 2 with the jaws in a closed position in the process of pinching a lock of hair.

Based on the first implementation and as shown more specifically in FIGS. 2A and 3, working surface $S_2$ of second jaw 2 is formed by straightening plate 5 which extends the entire width of second jaw 2, which is rigidly attached to it. Straightening plate 5 is then attached to electrical heating element 6 in contact with the back face of plate 5, located opposite working surface $S_2$. Electrical heating element 6 may be provided in any manner such as, for example, a CTP-resistant heating element or infrared. Therefore, electrical heating element 6 is located inside second jaw 2. Heating element 6 is designed, for example, to automatically maintain a predetermined target temperature. Heating element 6 could also be connected to controls (not shown) to allow the user to select a recommended temperature. The heating element and/or controls are powered by electrical energy using a cord that runs from an end of second jaw 2 opposite working surface $S_2$. Of course, the electrical current for hair-care device A could also be provided by batteries placed inside one or both jaws 1 and 2. Heating and control methods are well known in the art and therefore do not require further description for this invention.

Based on the example shown, surface $S_1$ of first jaw 1 is formed by straightening plate 7 which may be attached to first jaw 1 so that it can move back and forth in direction N perpendicular to working surface $S_1$. Accordingly, device A includes compelling mechanisms 8 between straightening plate 7 and first jaw 1. The compelling mechanisms can, for example, be formed by one or more helicoidal springs that naturally expand straightening plate 7 of first jaw 1. Accordingly, springs 8 push straightening plate 7 toward second jaw 2 and, more specifically, toward working surface $S_2$ of straightening plate 5.

In accordance with the example shown, alongside straightening plate 7, first jaw 1 also includes friction bar 10 which is mobile relative to working surface $S_1$ and, based on the example shown, also relative to first jaw 1. In accordance with the example shown, friction bar 10 extends along the edge left of straightening plate 7 and is mobile relative to the first jaw in direction N' parallel to direction N and, therefore, perpendicular to a plane defined by working surface $S_1$. Therefore, hair-care device A includes compelling mechanisms 11 between first jaw 1 and friction bar 10. Therefore, compelling mechanisms 11, which may be similar to compelling mechanisms 8, work to extend friction bar 10 of first jaw 1 and to push it toward second jaw 2.

Figure 2B:
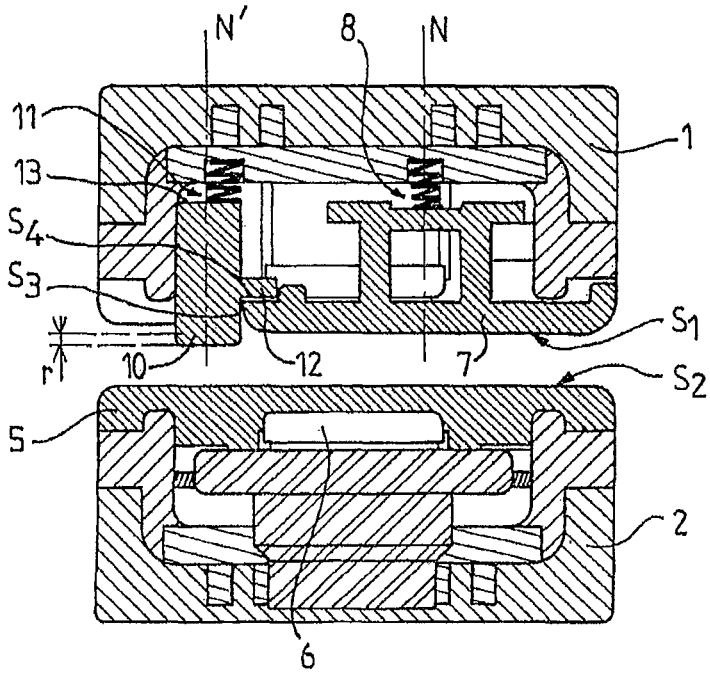
FIGS. 2B and 2C show a straight transverse section with alternatives from that shown in FIG. 2A.

Another implementation is shown in FIG. 2B. This applies all of the characteristics described herein for the mode shown in FIG. 2A and differs in that friction bar 10 is in thermal contact with working surface $S_1$.

The friction bar creates longitudinal projection 12 retracted from the surface of the friction region which is designed to contact hair. This protuberance supports internal surface $S_4$ of the straightening plate and/or the side of the friction bar which is in thermal contact with lateral surface $S_3$ of the straightening plate. Thermal conduction take place through these contacts against the side of the plate and under the lateral edges of the plate.

And, in particular, if the friction bar is mobile, the straightener in an open position. Using temperature testing, it has been determined that the friction bar may heated to a temperature near 100-110° C. when the temperature of the straightening plate approaches 150° C. This configuration may, of course, be applied to the implementations shown in FIGS. 4 and 5.

Figure 2C:
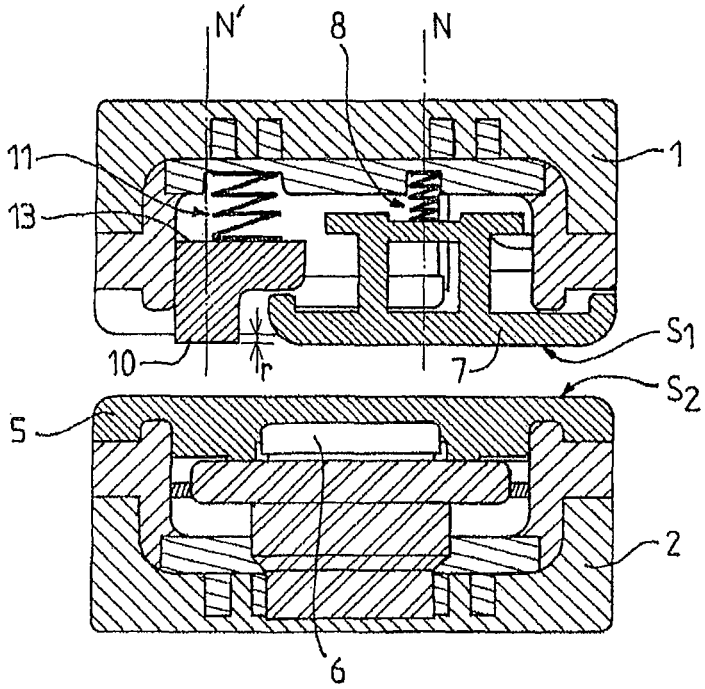

Another implementation similar to that shown in FIG. 2A is also shown in FIG. 2C. In this implementation, the friction bar includes internal base 13 which is larger than in the prior mode to allow a larger or wider fixation or pressure mechanism to be attached (a wider spring, for example) without requiring protuberance 12 of the implementation shown in FIG. 2B. This configuration may, of course, be applied to the implementations shown in FIGS. 4 and 5. The friction bar is located to the side of the exterior edge of the plate and in thermal contact with a straightening plate of the same jaw; this plate has a flat surface designed to make thermal contact with the lock of hair. The traction bar supports and is located under the lateral edges of the plate.

The tension strip may be mounted on at least two springs 11 which are substantially located close to the two longitudinal ends of the friction bar.

Accordingly, hair-care device A operates as follows. When a user would like to straighten a lock of hair L, he/she closes device A on the lock as shown in FIG. 2A. The user must ensure that friction bar 10 is held against scalp C relative to straightening plate 7. As a result, friction bar 10 then creates, with the portion facing straightening plate 5, traction region 12 of lock of hair L. Compelling mechanisms 11 and 8 are designed to put pressure on lock of hair L using friction bar 10, which is greater than that exerted by straightening plate 7. To this end, compelling mechanisms 11 are designed to exert pressure which exceeds that exerted by compelling mechanisms 8. It should be noted that the surfaces of straightening plates 5 and 7 create the treatment region 80 of device A. The difference in friction between traction region 12 and treatment region 80, along with the movement of the straightening device against the scalp in the direction of arrow $F_1$ causes tension on the portion of lock of hair L located between scalp C and traction region 12 and, in particular, in treatment region 80. It should be noted that, when moving the device, traction region 12 exerts greater traction $T_{12}$ on the hair than traction $T_{13}$ exerted by treatment region 13. Traction $T_{13}$ contributes to the straightening effect of the heat applied by straightening plate 5 of second jaw 2. Accordingly, this tension allows the better straightening results to be achieved than would be achieved using the same device without friction bar 10. To further increase the pressure differential and, therefore, the friction between treatment region 80 and traction region 12, friction bar 10 and straightening plate 13 of the first jaw are designed so that, when in an open position, there is a gap G between surface $S_1$ of plate 7 and the surface of the friction bar oriented toward the second jaw. The gap G measured simultaneously in directions N and N' can be, for example, between 0.1 mm and 5 mm, inclusive. It should be noted that the friction differential between treatment region 80 and the traction region may also be increased using surface conditions and/or materials for, in particular, straightening plate 7 and friction bar 10.

Figure 4:
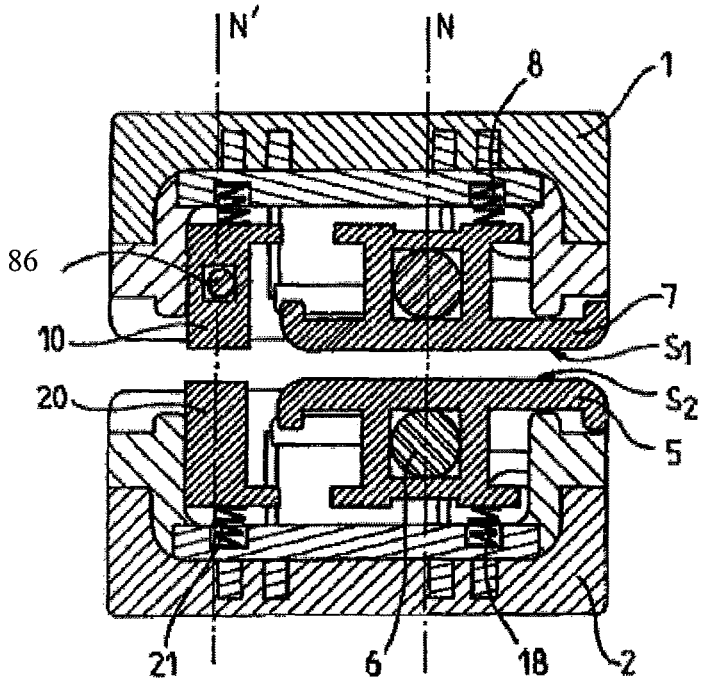
FIGS. 4 and 5 show straight transverse sections similar to FIG. 2 with various ways to implement the hair-care device in accordance with the invention.

Of course, in accordance with the invention, the two jaws 1 and 2 could each have a friction bar mounted on them. Accordingly, FIG. 4 shows an implementation of hair-care device 1 where the first and second jaw are in a basically symmetrical configuration, at least with respect to the treatment region 80.

Accordingly, in this example, straightening plate 5 of second jaw 2 is mounted on second jaw 2 so that it is mobile in direction N. Then, second jaw 2 includes compelling mechanisms 18 to push straightening plate 6 in direction of first jaw 1. Similarly, second jaw 2 then includes counter-friction bar 20 located in front of friction bar 10; counter-friction bar 20 is mobile in direction N' and is pushed toward first jaw 1 and, more specifically, toward friction bar 10 by compelling mechanisms 21. It should be noted that, in this example, two mobile straightening plates 5 and 7 are each attached to heating elements 6 and 22, respectively.

Implemented in this manner, the hair-care device is used in the same manner as described previously. It should be noted that the various implementations described in FIGS. 2A-2C and 3, on the one hand, and FIG. 4, on the other, all require that the friction bars be positioned against scalp 5 to ensure that there is tension on the portion of the lock located between the straightening plates in treatment region 80.

However, it is possible to avoid this orientation requirement in hair-care device A.

Figure 5:
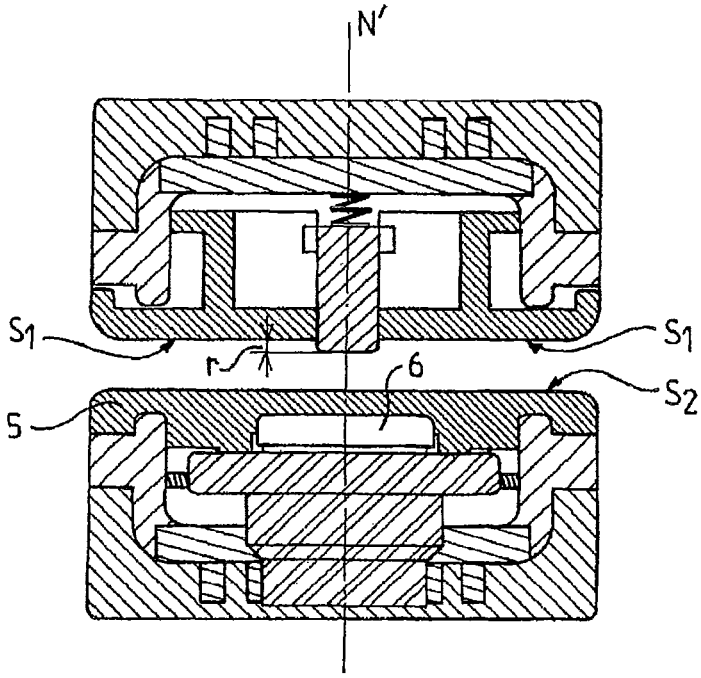

Accordingly, FIG. 5 shows another implementation of the hair-care device in accordance with the invention, in which first jaw 1 includes a friction bar basically in the center of the jaw and aligned to the median longitudinal plane thereof. Friction bar 10 then divides straightening plate 7 into two equal parts, respectively, left and right. It should be noted that, in accordance with this example, straightening plate 7 of the first jaw is rigidly attached thereto and is, therefore, not mobile, as described in the prior examples. Similarly, second jaw 2 is designed in essentially the same way as second jaw 2 of the device described in FIGS. 2A-2C and 3. Therefore, the central position of friction bar 10 ensures tension on the portion of lock of hair L located between friction bar 10 and the scalp as it is also in part of treatment region 80 bordered by the parts adjacent to straightening plate 5 and straightening plate 7. Of course, the hair-care device could be implemented using a design for the two jaws that is very similar to that of the first jaw described in FIG. 5. In this case, each half-straightening plate could be equipped with an electrical heating element.

Figure 6:
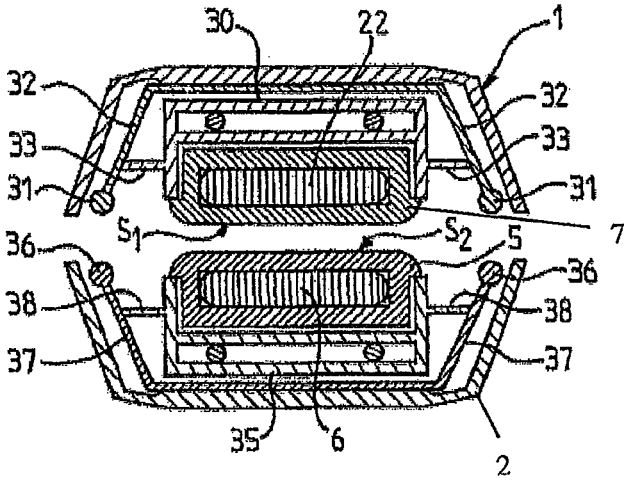
FIG. 6 shows a straight transverse section similar to FIG. 2 with another way of implementing the jaws of the hair-care device in an open position.
Figure 8:
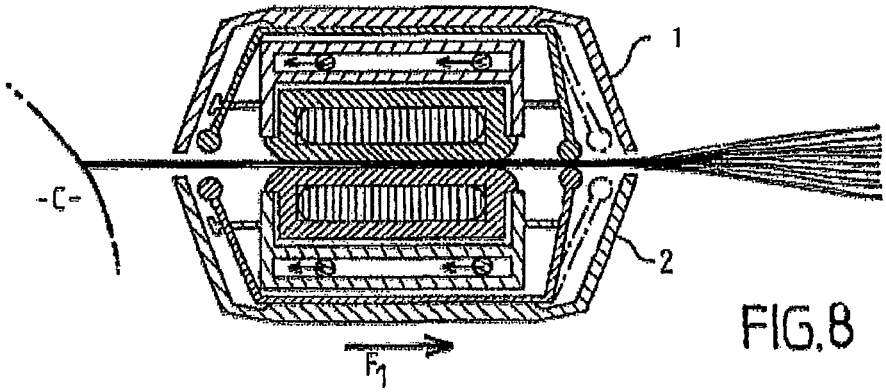
FIGS. 7 and 8 show similar sections to FIG. 5 of the jaws in a closed position and the operation of the friction bars implemented by these jaws based on the direction of movement of the jaws relative to hair to be straightened.
Figure 7:
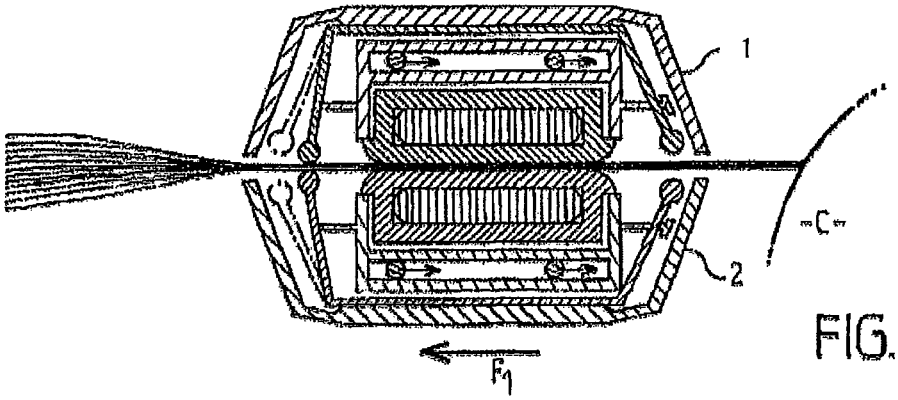

FIGS. 6 to 8 show another implementation of the hair-care device in accordance with the invention which also ensures adequate tension on the lock of hair to be treated regardless of the orientation of device A relative to the scalp.

In accordance with this implementation, the straightening plate of first jaw 1 is supported by mobile carriage 30 which moves parallel to working surface $S_1$. First jaw 1 also includes two friction bars 31, each of which hold a straightening plate 7. Each friction bar 31 is then mounted on the free end of arm 32, the opposite end of which is hinged on jaw 1. Each arm 32 on the first jaw may be hinged in any appropriate manner, e.g., as an elastic hinge or pivot connection. In the example shown, arms 32 are formed by elastic strips; their hinge near jaw 1 makes them elastic. Further, arms 32 are angled to the outside in direction of second jaw 2. Straightening plate 7 is also attached to traction fingers 33 which, in the example shown, are mounted on carriage 30. Each finger 33 is then designed to generate traction on the corresponding arm 32 when carriage 30 moves opposite that arm. However, each finger 33 is designed not to move the corresponding arm 32 when the carriage moves in direction thereof.

In the example shown, second jaw 2 is configured quite similar to first jaw 1; accordingly, straightening plate 5 is also mounted on mobile carriage 35 moving parallel to working surface $S_2$. Second jaw 2 also includes two counter-friction bars 36, each mounted on the free end of a hinged arm which is very similar to hinged arm 32. Carriage 35 also includes traction fingers 38 which are positioned similarly to traction fingers 33. Finally, in this example, each of straightening plates 5 and 7 includes heating elements 6 and 22, respectively.

The straightening device implemented in this manner operates as shown in more detail in FIGS. 7 and 8.

When hair-care device A is placed, for example, to the left of scalp C, as shown in FIG. 7, when traction in the direction of arrow $F_1$ is generated, straightening plates 5 and 7 tend to move in opposite directions as shown by the arrows. This relative motion of straightening plates 5 and 7, to the right relative to the jaws to which they are attached, generates traction on left arms 32 and 37 which moves them toward both left friction bars 31 and 36, which pinches lock of hair L. Friction generated in the traction region created by the closing bar and the counter-bar stretches the portion of lock of hair L located between the traction region and the scalp. It should be noted that, in this region, friction bar 31 and corresponding counter-friction bar 36 located to the right are not working and do not have any effect on the lock of hair.

In the opposite configuration, as shown in FIG. 8, it should be noted that it is the right friction bars that work, while the left friction bars are at rest. Therefore, this implementation allows symmetrical operation of the device and frees the user from having to take into consideration the placement the device relative to the lock of hair and the scalp to ensure proper treatment.

In addition, it should be noted that the various implementations of the hair-care device in accordance with the invention allow the user to generate adequate tension on the locks of hair to be straightened using only the hair-care device implemented in accordance with the invention in one hand without having to use the other hand, which makes straightening easier.

In the examples described above in FIGS. 1 to 8, each friction bar is mobile relative to the adjacent working surface within a plane perpendicular to longitudinal axis L of the corresponding jaw. However, in accordance with the invention, another type of friction bar movement could be provided for.

Figure 9:
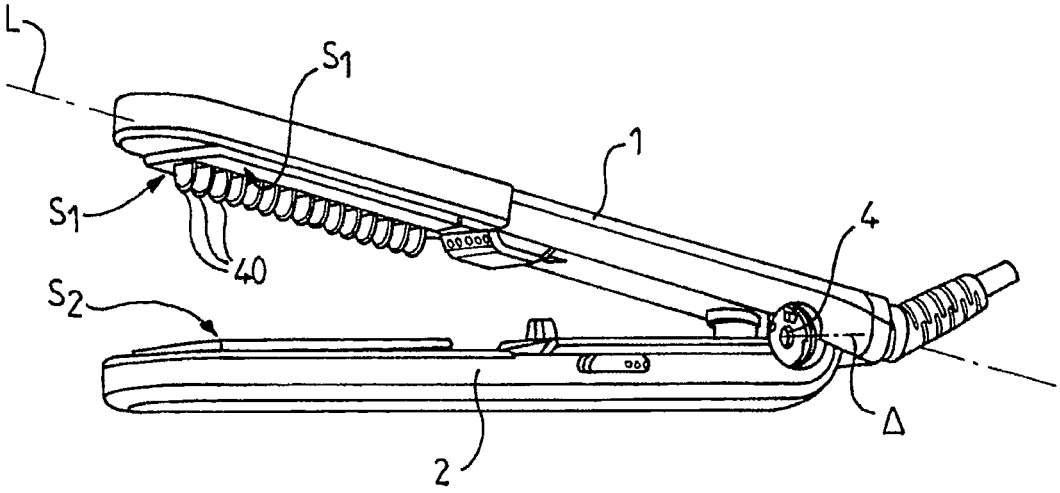
FIG. 9 shows another implementation of the hair-care device in which the first jaw includes multiple friction bars.
Figure 10:
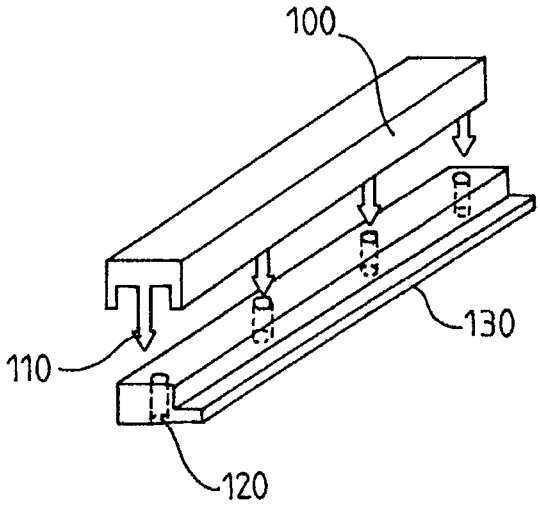
FIG. 10 shows an example of attaching a silicone layer to the surface of the friction strip.
Figure 11:
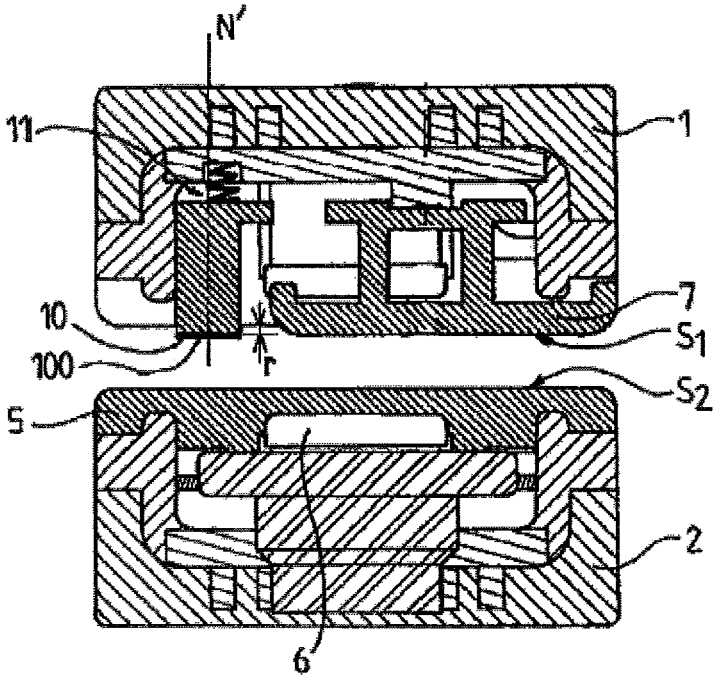
FIG. 11 shows a straight transverse section along line II-II of the jaws of the hair-care device illustrated in FIG. 1 with the jaws in an open position in accordance with an embodiment of the present invention.

Accordingly, FIG. 9 shows another implementation of the hair-care device in which, first jaw 1 includes multiple friction bars 40 which are each mobile relative to adjacent working surface $S_1$ in a direction parallel to longitudinal axis L of first jaw 1. Each friction bar then forms a tooth extending in a plane perpendicular to working surface $S_1$ and the longitudinal axis. First jaw 1 also includes movement mechanisms, which are not shown, to move the teeth toward one another when device A is closed so that two pairs of teeth create traction regions in which the hair is pinched. A fixed counter-tooth could be placed between each mobile tooth 40 toward which one of the mobile teeth would be moved when device A is closed to create a traction region with the corresponding counter-tooth. P FIG. 10 shows an example of attaching a layer of material 100 to improve the tension and/or resistance on the surface of the friction strip. This layer should be of uniform thickness and may have a surface designed to be in contact with the basically flat hair. We have seen that this layer may be layered over, laid on or slid over using friction strip clip 130. FIG. 10 shows an attachment mechanism using arrow-heads 110 designed to be inserted into and attached to at least two holes 120 drilled perpendicular to the longitudinal axis of the friction bar.

The layer of high-friction material 100 may provide a retraction area on the longitudinal edges to avoid stopping operation and damaging the hair. This layer of high-friction material 100 may be attached permanently or temporarily so that the layer can be replaced or the configuration changed to that of a standard straightener without a friction strip.

Friction clip 130 on which layer 100 of the high-friction element is attached may be extruded in aluminum or an equivalent substance.

The combination of a silicone-type high-friction material with the mobile friction bar structure can be used, on an exceptional basis, to increase the tension applied to hair while not damaging it.

In addition, the hair-care device in accordance with the invention may also include, in front of or behind the traction region, a mechanism to apply cosmetic products to the hair. The products applied may, for example, be contained in one or more removable cartridges.

Similarly, to optimize implementation effectiveness, the hair-care device in accordance with the invention may also include mechanisms to produce vapor to apply a vapor flow to the hair in front of or behind the traction region.

Of course, various other modifications may be made to the invention in the attached claims.

The invention claimed is:

1. A hair-care device comprising:

at least a first elongated jaw having a working surface and a second elongated jaw having a working surface, wherein the first and second jaws are hinged to one another to shift between an open position and a closed position in which the working surfaces of the first and second jaws create a hair treatment region when in the closed position, and electrical heating elements attached to at least one of the working surfaces, wherein the first jaw includes at least one friction bar which is adjacent to the working surface on the first jaw and mobile relative to the working surface on the first jaw, the at least one friction bar is adapted to work with an opposing element to create a traction region when the jaws are closed on a lock of hair, and when the device is moved along the lock of hair, a traction force is generated in the traction region which exceeds the traction force generated by the treatment region, and wherein compelling mechanisms located between the friction bar and first jaw extend the friction bar out from the first jaw.

2. The hair-care device of claim 1, wherein the element that works with the friction bar is mounted on the second jaw.

3. The hair-care device of claim 1, wherein the compelling mechanisms comprise one or more springs compressed between the friction bar and the first jaw.

4. The hair-care device of claim 1, wherein the working surface of the first jaw, adjacent to the first friction bar, is formed by a straightening plate which is mobile relative to the first jaw.

5. The hair-care device of claim 4, further comprising compelling mechanisms are located between the straightening plate and the first jaw.

6. The hair-care device of claim 5, wherein the compelling mechanisms attached to the straightening plate exert less pressure on the straightening plate than that exerted on the friction bar by the compelling mechanisms located between the friction bar and first jaw and which are acting on the friction bar.

7. The hair-care device of claim 1, wherein the second jaw includes at least one counter-friction bar located opposite the at least one friction bar of the first jaw where the counter-friction bar is adjacent to the working surface on the second jaw and mobile relative to the working surface on the second jaw.

8. The hair-care device of claim 1, wherein, when the first and second jaws are open, each working surface of the first and second jaw is retracted from each friction bar mounted on the first and second jaw.

9. The hair-care device of claim 8, wherein a retraction distance measured perpendicularly to the working surface is between 0.1 mm and 5 mm.

10. The hair-care device of claim 1, wherein the at least one friction bar is heated by electrical heating elements on the adjacent working surface of the first jaw.

11. The hair-care device of claim 1, wherein the at least one friction bar is in thermal contact with a straightening plate placed on the same jaw.

12. The hair-care device of claim 1, wherein the at least one friction bar is at least partially covered by a material which is resistant to high temperatures.

13. The hair-care device of claim 12, wherein the material is a silicone.

14. A hair-care device comprising:

a first jaw having a working surface;

a second jaw having a working surface, wherein the first and second jaws are hinged to one another to shift between an open position and a closed position in which the working surfaces of the first and second jaws create a hair treatment region when in the closed position;

an arm hinged at one end to the first jaw;

a first friction bar is attached to a free end of the arm that is located opposite the hinged end of the arm, the first friction bar is adapted to work with an element on the second jaw to create a first traction region with a coefficient of friction that exceeds the coefficient of friction of the treatment region, the working surface of the first jaw is formed by a straightening plate attached to a traction finger, wherein the straightening plate is mobile on the first jaw, and moves perpendicularly to a longitudinal axis of the first jaw, wherein the traction finger is designed to exert traction on the hinged arm when the straightening plate moves opposite the first friction bar.

15. The hair-care device of claim 14, wherein:

the first jaw comprises a second friction bar located opposite the first friction bar relative to the straightening plate and is mounted on a free end of a second arm which is hinged, by an opposite end of the second arm, on the first jaw;

the second friction bar is adapted to work with an element on the second jaw to create a second traction region with a coefficient of friction that exceeds the coefficient of friction of the treatment region; and the straightening plate of the first jaw is attached to a second traction finger designed to exert traction on the second hinged arm when the straightening plate moves opposite the second friction bar.

16. The hair-care device of claim 15, wherein:

the second jaw includes a counter-friction bar which is attached to a free end of an arm which is hinged with an opposite end on the second jaw;

the counter-friction bar is located opposite the first friction bar of the first jaw to create the first traction region; and the working surface of the second jaw is formed by a second straightening plate, relative to the second jaw, that is attached to a traction finger, wherein the second straightening plate is mobile and moves perpendicularly to a longitudinal axis of the second jaw, wherein the traction finger attached to the second straightening plate of the second jaw is adapted to exert traction on the arm hinged to the second jaw when the second straightening plate moves opposite the counter-friction bar.

17. The hair-care device of claim 16, wherein:

the second jaw comprises a second counter-friction bar which is located opposite the first counter-friction bar relative to a second straightening plate, the second counter-friction bar is mounted on a free end of a second arm of the second jaw which is hinged with an opposite end on the second jaw;

the second counter-friction bar is designed to work with the second friction bar of the first jaw to create the second traction region; and the second straightening plate is attached to a second traction finger of the second jaw to exert traction on the second hinged arm of the second jaw when the second straightening plate moves opposite the second counter-friction bar.

* * * * *

UNITED STATES PATENT AND TRADEMARK OFFICE

CERTIFICATE OF CORRECTION

PATENT NO. : 8,789,539 B2
APPLICATION NO. : 13/144240
DATED : July 29, 2014
INVENTOR(S) : Benoît Linglin It is certified that error appears in the above-identified patent and that said Letters Patent is hereby corrected as shown below:

In the Claims

Column 11, Line 36, Claim 14, after "bar" delete "is"

Signed and Sealed this
Ninth Day of December, 2014

Michelle K. Lee

Michelle K. Lee
*Deputy Director of the United States Patent and Trademark Office*